US008678785B2

(12) United States Patent
Nogami et al.

(10) Patent No.: US 8,678,785 B2
(45) Date of Patent: Mar. 25, 2014

(54) VENTILATION FAN

(75) Inventors: Sakae Nogami, Kyoto (JP); Hirotsugu Yokotani, Kyoto (JP); Kenji Iwamoto, Kyoto (JP)

(73) Assignee: Nidec Corporation, Kyoto (JP)

( * ) Notice: Subject to any disclaimer, the term of this patent is extended or adjusted under 35 U.S.C. 154(b) by 635 days.

(21) Appl. No.: 12/846,892

(22) Filed: Jul. 30, 2010

(65) Prior Publication Data

US 2011/0027075 A1 Feb. 3, 2011

(30) Foreign Application Priority Data

Aug. 3, 2009 (JP) ..... 2009-180396

(51) Int. Cl.

| | |
|---|---|
| ***F04B 17/00*** | (2006.01) |
| ***F04B 35/04*** | (2006.01) |
| ***F04D 29/08*** | (2006.01) |
| ***F01D 11/00*** | (2006.01) |
| ***F01D 11/02*** | (2006.01) |

(52) U.S. Cl.
USPC ..... 417/410.1; 415/174.3; 415/174.5

(58) Field of Classification Search
USPC ..... 417/410.1; 415/170.1, 174.3, 174.5, 415/171.1
See application file for complete search history.

(56) References Cited

U.S. PATENT DOCUMENTS

| | | | | |
|---|---|---|---|---|
| 6,158,985 | A * | 12/2000 | Watanabe et al. | 417/423.14 |
| 6,551,074 | B2 | 4/2003 | Kudo et al. | |
| 6,798,091 | B2 | 9/2004 | Kudou et al. | |
| 7,117,580 | B2 | 10/2006 | Kudou et al. | |
| 7,589,444 | B2 * | 9/2009 | Teshima et al. | 310/68 B |
| 7,679,230 | B2 * | 3/2010 | Yamada et al. | 310/43 |
| 7,841,832 | B2 * | 11/2010 | Kitamura | 416/144 |
| 8,029,251 | B2 * | 10/2011 | Oguma | 417/354 |
| 2007/0122293 | A1 * | 5/2007 | Sugiyama et al. | 417/354 |
| 2007/0207044 | A1 * | 9/2007 | Nagamitsu et al. | 417/354 |

FOREIGN PATENT DOCUMENTS

| | | | |
|---|---|---|---|
| CN | 101270758 | A | 9/2008 |
| JP | 10-191611 | A | 7/1998 |
| JP | 11-037088 | A | 2/1999 |
| JP | 2000-014072 | A | 1/2000 |
| JP | 2000-110773 | A | 4/2000 |
| JP | 2000-116098 | A | 4/2000 |
| JP | 2001-107893 | A | 4/2001 |
| JP | 2607390 | Y2 | 7/2001 |
| JP | 2003-111373 | A | 4/2003 |
| JP | 2005-076473 | A | 3/2005 |

* cited by examiner

*Primary Examiner* — Devon Kramer
*Assistant Examiner* — Lilya Pekarskaya
(74) *Attorney, Agent, or Firm* — Keating & Bennett, LLP

(57) ABSTRACT

A ventilation fan includes a rotor holder rotating around a rotation axis, an impeller cup including a plurality of blades provided on an outer circumference thereof, and a base portion arranged to rotatably support the rotor holder through a bearing portion. The base portion includes an outer circumferential wall extending upwards in an axial direction from an outer circumferential edge portion thereof. A gap defining a labyrinth structure is provided between an upper end portion of the outer circumferential wall of the base portion and a lower end portion of an outer circumferential portion of the impeller cup. A lower end portion of a cylindrical portion is located axially lower than the upper end portion of the outer circumferential wall of the base portion.

13 Claims, 14 Drawing Sheets

VENTILATION FAN

BACKGROUND OF THE INVENTION

1. Field of the Invention

The present invention relates to a fan. More specifically, the present invention relates to a ventilation fan including waterproof and dustproof mechanisms.

2. Description of the Related Art

A ventilation fan such as an axial fan or a centrifugal fan typically includes an impeller having a plurality of blades, a motor arranged to rotate the impeller, and a circuit board for motor rotation control. Each of the impeller, the motor, and the circuit board are accommodated in a housing.

Depending on the environment in which a ventilation fan is used, water, dust, or the like may disadvantageously enter into the housing from the outside. If water or dust enters into the motor or the circuit board, this causes a problem in which the motor may break down, so that the ventilation fan cannot operate.

In view of such a problem, Japanese Laid-Open Patent Publication No. 10-191611 discloses a technique in which a stator portion of a motor and a circuit board are molded with a resin.

However, the technique requires extra time and cost necessary to form the resin mold, which thus leads to an increase the cost of the ventilation fan.

Japanese Laid-Open Patent Publication No. 2000-110773 discloses a technique in which a labyrinth structure is provided in a gap between an open-side end portion of an impeller cup and an open-side end portion of an outer wall portion of a motor supporter.

However, in the technique disclosed in Japanese Laid-Open Patent Publication No. 2000-110773, it is necessary to provide a cylindrical inner wall portion in the motor supporter and an annular flange in an open-side end portion of the inner wall portion in addition to the gap for constituting the labyrinth structure. These requirements cause the structure of the ventilation fan to become complicated.

SUMMARY OF THE INVENTION

Preferred embodiments of the present invention provide a ventilation fan having a simple structure with superior waterproof and dustproof mechanisms.

A ventilation fan according to one preferred embodiment of the present invention includes: a rotor holder having a substantially cylindrical shape, the rotor holder being arranged to rotate around a rotation axis; a field magnet fixed to an inner circumference of the rotor holder; an impeller cup having a substantially cylindrical shape and arranged to be fixed to an outer circumference of the rotor holder, the impeller cup including a plurality of blades defined on an outer circumference thereof; a base portion arranged to rotatably support the rotor holder through a bearing portion and a bearing holding portion; and a stator portion arranged to be supported by the bearing holding portion; wherein the base portion includes an outer circumferential wall extending upwards in an axial direction from an outer circumferential edge portion thereof, a gap constituting a labyrinth structure is provided between an upper end portion of the outer circumferential wall of the base portion and a lower end portion of an outer circumferential portion of the impeller cup, the impeller cup includes a cylindrical portion which is arranged to extend in the axial direction inside the outer circumferential portion thereof; and a lower end portion of the cylindrical portion is located axially lower than the upper end portion of the outer circumferential wall of the base portion.

With the above-described configuration, in addition to the provision of the labyrinth structure in the gap between the upper end portion of the outer circumferential wall of the base portion and the lower end portion of the outer circumferential portion of the impeller cup, it is possible to provide a second labyrinth structure in a gap between the upper end portion of the outer circumferential wall of the base portion and the lower end portion of the cylindrical portion. Accordingly, it is possible to realize a ventilation fan having double labyrinth structure with waterproof and dustproof mechanisms with a simple construction.

The above and other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
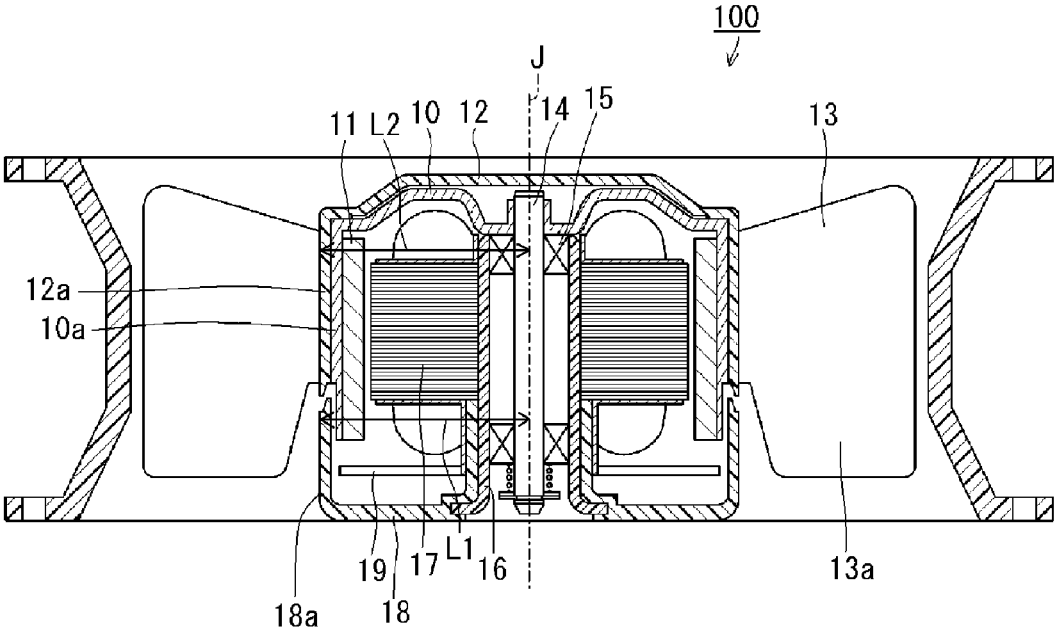
FIG. 1 is a sectional view schematically showing a construction of a ventilation fan according to a first preferred embodiment of the present invention.

Referring to FIGS. 1 through 14B, preferred embodiments of the present invention will be described in detail. It should be noted that in the explanation of preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel or substantially parallel to a rotation axis, and a radial direction indicates a direction perpendicular or substantially perpendicular to the rotation axis.

First Preferred Embodiment

FIG. 1 is a sectional view schematically showing a construction of a ventilation fan 100 according to a first preferred embodiment of the present invention. An axial fan is exemplarily described in this preferred embodiment, but it is noted that the present invention can also be applied to a centrifugal fan.

As shown in FIG. 1, a rotor holder 10 having a substantially cylindrical shape is arranged to rotate around a rotation axis J as a center. An impeller cup 12 having a substantially cylindrical shape is fixed to an outer circumference of the rotor holder 10. The impeller cup 12 includes a plurality of blades 13 on an outer circumference thereof. The rotor holder 10 is rotatably supported by a base portion 18 via a shaft 14, a bearing portion 15 including a ball bearing, and a bearing holding portion 16. On an inner circumference of the rotor holder 10, a field magnet 11 is fixed. A stator 17 is fixed to the bearing holding portion 16. The base portion 18 has an outer circumferential wall 18*a* extending upwards in an axial direction in a circumferential portion thereof. A circuit board 19 arranged to control the rotation and driving of a motor is preferably disposed between the base portion 18 and the stator 17.

Figure 2:
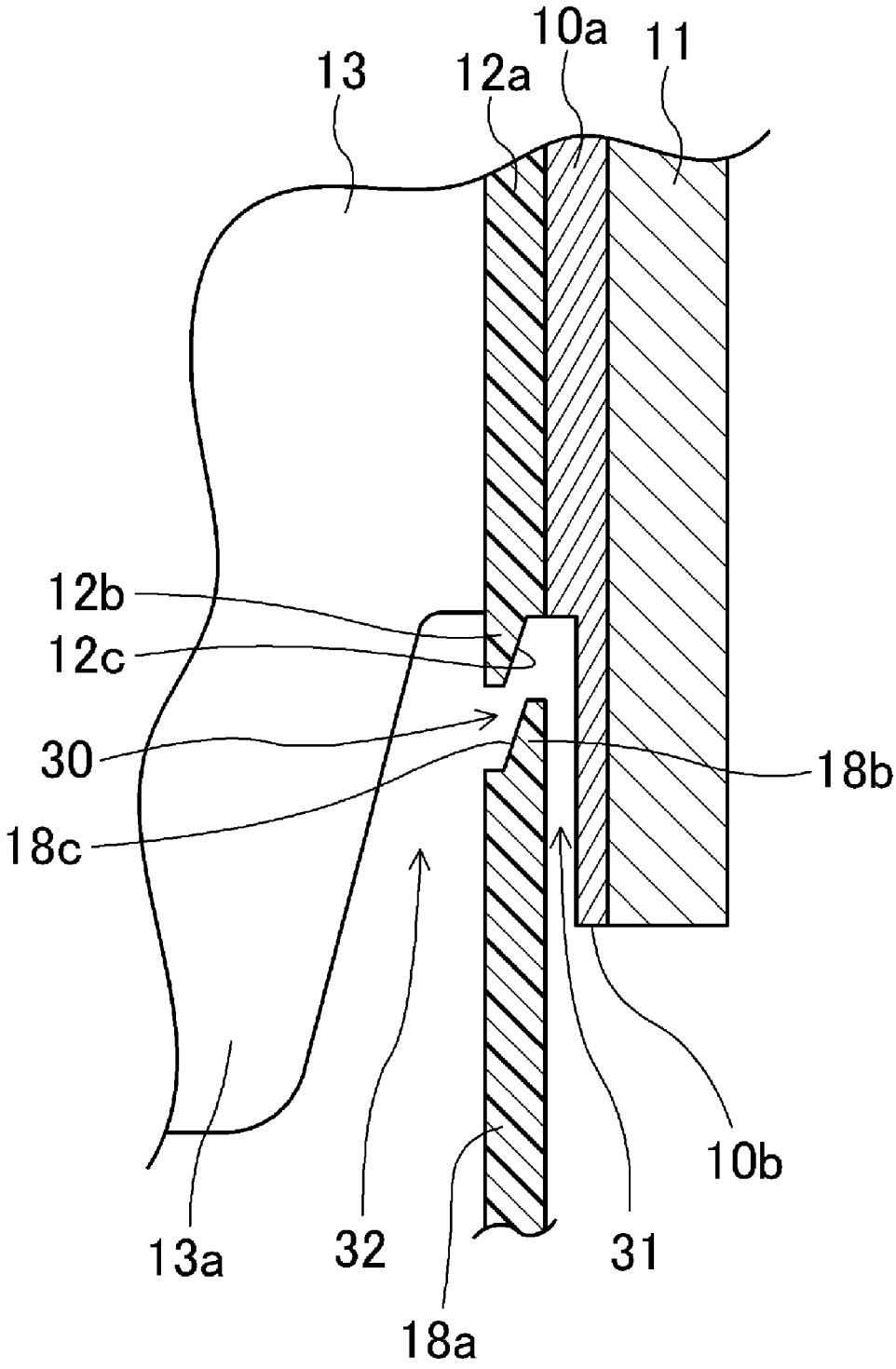
FIG. 2 is a partially enlarged sectional view in the vicinity of an outer circumferential wall of a base portion shown in FIG. 1.

FIG. 2 is a partially enlarged sectional view in the vicinity of the outer circumferential wall 18*a* of the base portion 18 shown in FIG. 1. As shown in FIG. 2, a gap 30 defining a first labyrinth structure is disposed between an upper end portion 18*b* of the outer circumferential wall 18*a* of the base portion 18 and a lower end portion 12*b* of the outer circumferential portion 12*a* of the impeller cup 12. A lower end portion 10*b* of an outer circumferential portion 10*a* of the rotor holder 10 is located axially lower than the upper end portion 18*b* of the outer circumferential wall 18*a* of the base portion 18. Accordingly, the outer circumferential wall 18*a* of the base portion 18 and the outer circumferential portion 10*a* of the rotor holder 10 constitute a second labyrinth structure.

As described above, the first labyrinth structure defined by the gap 30 can easily be provided only by setting relative positions in radial and axial directions of the outer circumferential wall 18*a* of the base portion 18 and the outer circumferential portion 12*a* of the impeller cup 12 to be predetermined positions. In addition, the second labyrinth structure defined by the gap 31 can easily be provided by setting relative positions in the radial and axial directions of the outer circumferential wall 18*a* of the base portion 18 and the outer circumferential portion 10*a* of the rotor holder 10 to be predetermined positions. Accordingly, it is possible to provide a ventilation fan having double labyrinth structure with waterproof and dustproof mechanisms with such a simple construction.

The term "labyrinth structure" in the present invention means a structure in which a flow path from the inside to the outside via "a gap" is substantially inflected. As for a fluid flowing through such an inflected flow path, the pressure loss is increased and the flow path resistance is increased, thereby attaining a sealing effect. Because of this sealing effect, water, dust, and the like which get into the housing from the outside can be prevented from entering into the motor and the circuit board 19 contained therein. The size of the "gap" and the inflected shape of the flow path may appropriately be determined in view of the use conditions and the like of the ventilation fan.

When the ventilation fan rotates, the pressure on the outer side in the radial direction of the gap 30 (i.e., on the side of the blades 13) is lower than that on the inner side in the radial direction (i.e., on the side of the circuit board 19), so that it is possible to attain an exhaustion effect in which any water and dust which enters inside in the radial direction of the gap 30 will be exhausted to the outer side in the radial direction of the gap 30.

In an axial fan, airflow is preferably generated from the top to the bottom in the axial direction in response to the rotation of the blades 13. Accordingly, as shown in FIG. 2, opposed surfaces 18*c* and 12*c* which are opposed via the gap 30 between the upper end portion 18*b* of the outer circumferential wall 18*a* of the base portion 18 and the lower end portion 12*b* of the outer circumferential portion 12*a* of the impeller cup 12 are preferably inclined upwards toward the inner side in the radial direction with substantially the same inclination angles. With such a configuration, a flow path in a direction reversed from the airflow direction is generated, so that the sealing effect can be further attained.

Figure 3E:
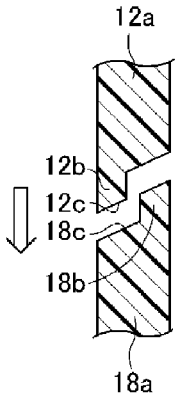
FIGS. 3A to 3H are partial sectional views showing exemplary patterns of opposed surfaces in an upper end portion of the base portion and a lower end portion of an impeller cup.
Figure 3F:
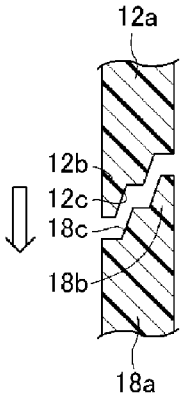
Figure 3G:
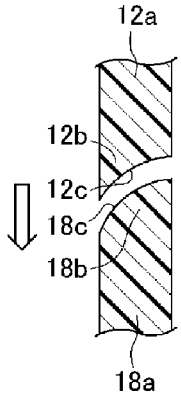
Figure 3H:
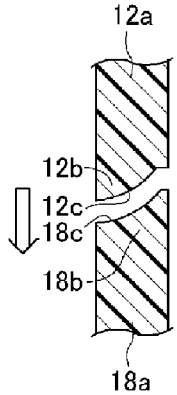
Figure 3A:
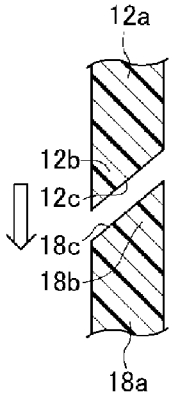
Figure 3B:
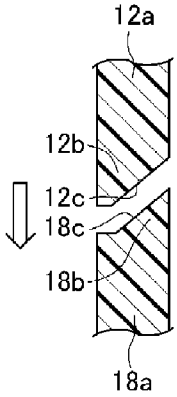
Figure 3C:
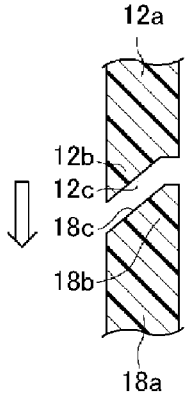
Figure 3D:
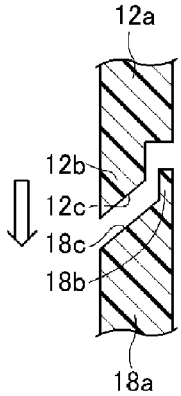
Figure 4A:
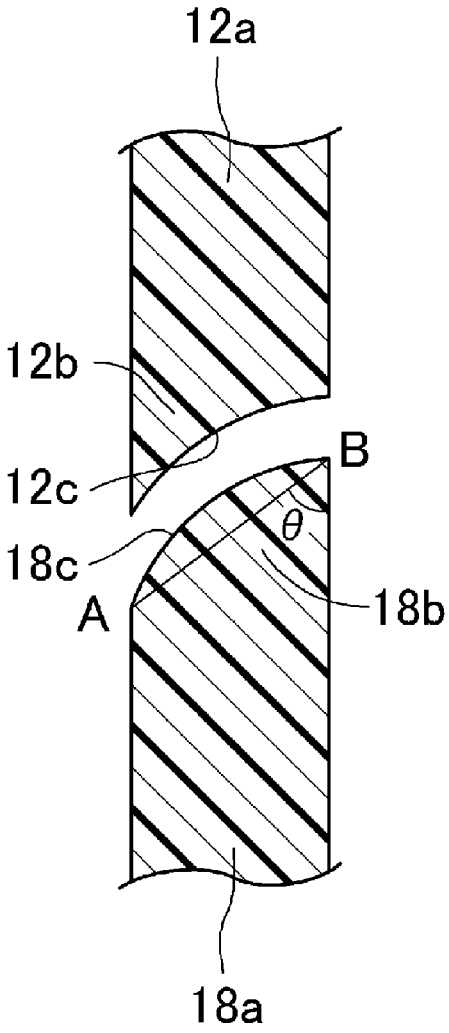
FIGS. 4A and 4B are partial sectional views illustrating inclination angles of the opposed surfaces in FIGS. 3G and 3H.
Figure 4B:
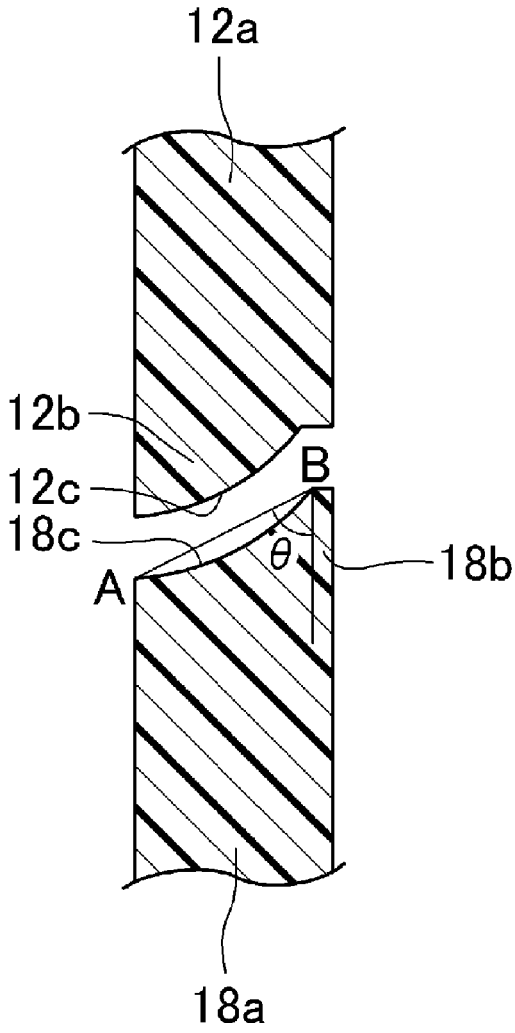

The inclined surfaces of the respective opposed surfaces 18*c* and 12*c* may be formed on at least a portion of the surfaces of the upper end portion 18*b* of the outer circumferential wall 18*a* of the base portion 18 and the lower end portion 12*b* of the outer circumferential portion 12*a* of the impeller cup 12, and the shapes and forms are not specifically limited. FIGS. 3A to 3H are partial sectional views exemplarily showing various patterns of preferred embodiments of the opposed surfaces 18*c* and 12*c* according to the present invention. Arrows in these figures indicate the direction of airflow. The inclined surfaces of the respective opposed surfaces 18*c* and 12*c* may be provided over the entire surface of the opposed surfaces 18*c* and 12*c*, as shown in FIG. 3A, or may be instead be provided in only a portion of the opposed surfaces 18*c* and 12*c*, as shown in FIGS. 3B to 3F. FIGS. 3B to 3D show preferred embodiments of the present invention where the inclined surfaces are provided in one location, and FIGS. 3E and 3F show preferred embodiments of the present invention where the inclined surfaces are defined in two locations. As shown in FIGS. 3G and 3H, the inclined surfaces may be rounded. In addition, the inclination angles of the respective opposed surfaces 18*c* and 12*c* are preferably in the range of about 20° to about 50° with respect to the axial direction. In the case where the inclined surfaces are rounded as shown in FIGS. 3G and 3H, the inclination angles of the respective opposed surfaces 18*c* and 12*c* are angles θ defined by the line segment AB with respect to the axial direction, as shown in FIGS. 4A and 4B. In the present preferred embodiments, as shown in FIGS. 3A to 3H, the lower end portion 12*b* of the outer circumferential portion 12*a* of the impeller cup 12 is located axially lower than the upper end portion 18*b* of the outer circumferential wall 18*a* of the base portion 18, thereby further heightening the sealing effect. In addition, when the lower end portion 12*b* of the outer circumferential portion 12*a* of the impeller cup 12 is located axially lower than the upper end portion 18*b* of the outer circumferential wall 18*a* of the base portion 18 over the entire circumference, the higher sealing effect can be expected.

It is preferred that the lower end portion 10*b* of the outer circumferential portion 10*a* of the rotor holder 10 be extended to the vicinity of the circuit board 19. With such a configuration, the gap 31 between the outer circumferential wall 18*a* of the base portion 18 and the outer circumferential portion 10*a* of the rotor holder 10 can be elongated, so that the sealing effect can be further attained.

In addition, as shown in FIG. 1, a portion of the lower end portion of the blade 13 may be provided with an extending portion 13*a* which extends axially downwards on the outer side in the radial direction of the outer circumferential wall 18*a* of the base portion 18. With such a configuration, it is possible to design a blade shape with highly free degrees depending on the characteristic requirements such as an increase in airflow or static pressure, or a decrease in noise. In addition, as shown in FIG. 2, by the provision of the extending portion 13*a* which extends axially downwards beyond the upper end portion 18*b* of the outer circumferential wall 18*a* of the base portion 18 on the outer side in the radial direction of the outer circumferential wall 18*a* of the base portion 18, a third labyrinth structure is defined by a gap 32 between the extending portion 13*a* of the rotating blade 13 and the outer circumferential wall 18*a* of the base portion 18. With such a configuration, the sealing effect can be further strengthened.

As shown in FIG. 1, if the base maximum radial measurement L1 in the outside portion of the outer circumferential wall 18*a* of the base portion 18 is substantially equal to the impeller cup maximum radial measurement L2 in the outside portion of the outer circumferential portion 12*a* of the impeller cup 12, or if the base maximum radial measurement L1 is smaller than the impeller cup maximum radial measurement L2, the air-flow characteristics will not be deteriorated, the generation of noise can be suppressed, and the high sealing effect can be attained. The base portion 18 in this preferred embodiment preferably has such a shape that the outside portion of the outer circumferential wall 18*a* of the base portion 18 extends in parallel or substantially in parallel with the center axis. Alternatively, the base portion 18 may have such a cup-like shape that the radial measurement of the outside portion of the outer circumferential wall 18*a* of the base portion 18 is gradually reduced from the axially upper side to the axially lower side. In such a case, if the above-mentioned relationship between L1 and L2 is established, the air-flow characteristics will not be deteriorated, the generation of noise can be suppressed, and the high sealing effect can be attained.

Second Preferred Embodiment

An impeller cup 12 is fixed on an outer circumference of a rotor holder 10. A plurality of ribs extending in an axial direction are arranged inside an outer circumferential portion 12*a* of the impeller cup 12. The rotor holder 10 is, for example, press fitted into the impeller cup 12, and fixed thereto.

In the first preferred embodiment of the present invention, the lower end portion 10*b* of the outer circumferential portion 10*a* of the rotor holder 10 is located axially lower than the upper end portion 18*b* of the outer circumferential wall 18*a* of the base portion 18, thereby defining the gap 31 which defines the second labyrinth structure. In the second preferred embodiment of the present invention, lower end portions of the plurality of ribs are located axially lower than the upper end portion 18*b* of the outer circumferential wall 18*a* of the base portion 18 instead of the outer circumferential portion 10*a* of the rotor holder 10 to thereby provide a gap 31 which defines the second labyrinth.

Figure 5:
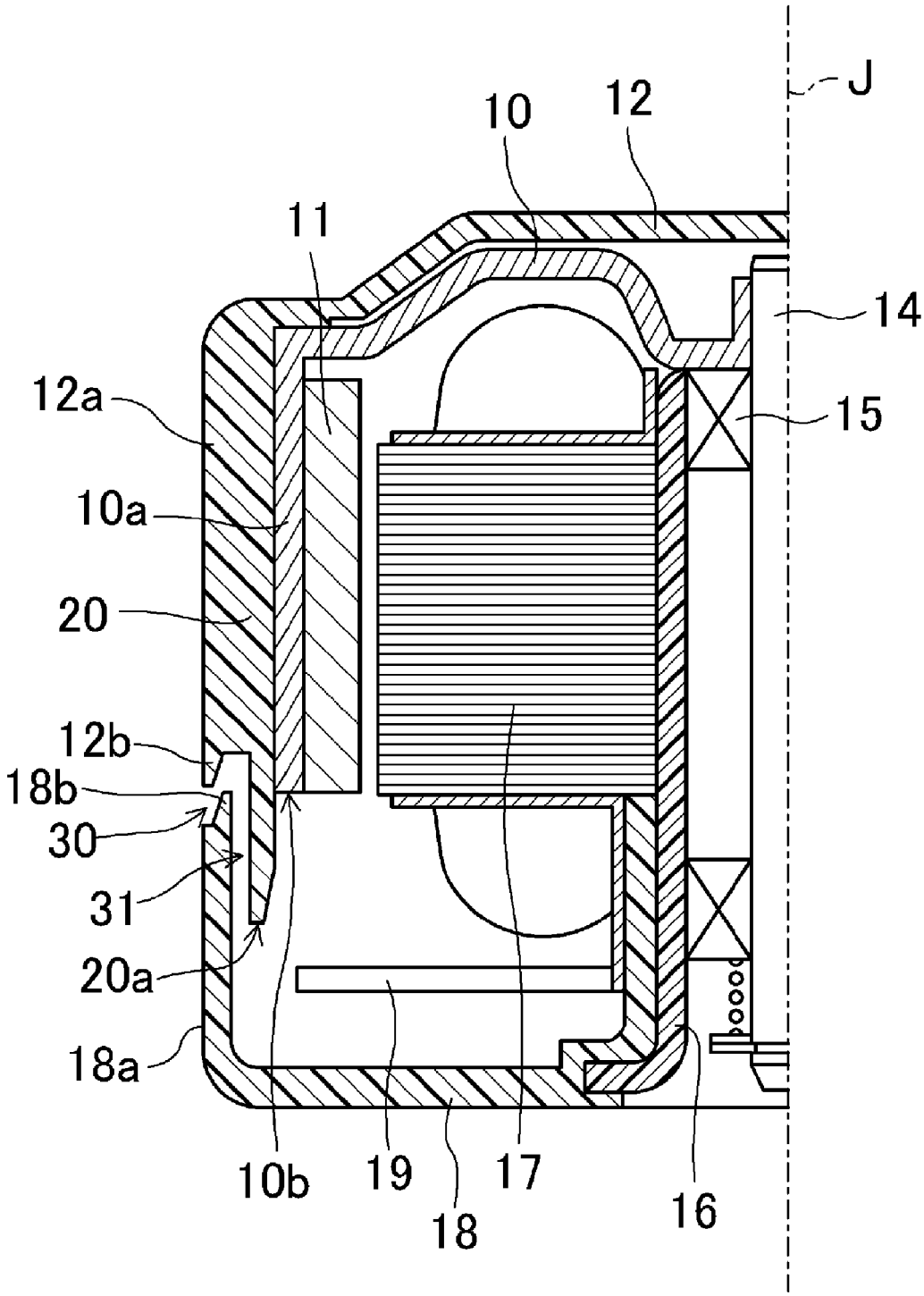
FIG. 5 is a half sectional view showing a construction of a motor portion in a ventilation fan according to a second preferred embodiment of the present invention.
Figure 6:
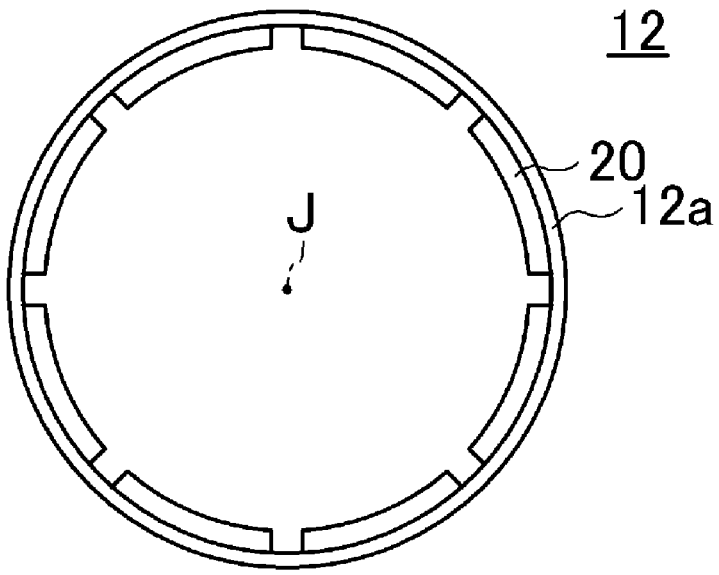
FIG. 6 is a plan view of an impeller cup in the second preferred embodiment, when viewed from the bottom thereof.

FIG. 5 is a half sectional view showing the construction of a motor portion in a ventilation fan according to the second preferred embodiment of the present invention. FIG. 6 is a plan view of the impeller cup 12 when it is viewed from the bottom.

As shown in FIGS. 5 and 6, the impeller cup 12 preferably includes a plurality of ribs 20 which axially extend inside the outer circumferential portion 12*a*, and the rotor holder 10 is press fitted and fixed thereto. Lower end portions 20*a* of the plurality of ribs 20 are located axially lower than the upper end portion 18*b* of the outer circumferential wall 18*a* of the base portion 18. Accordingly, a gap 31 provided between the outer circumferential wall 18*a* of the base portion 18 and the outer circumference of each rib 20 defines the second labyrinth structure. It is noted that a first labyrinth structure defined by a gap 30 between the upper end portion 18*b* of the outer circumferential wall 18*a* of the base portion 18 and the lower end portion 12*b* of the outer circumferential portion 12*a* of the impeller cup 12 is the same as that of the first preferred embodiment of the present invention.

In the second preferred embodiment of the present invention, the first labyrinth structure defined by the gap 30 can be easily provided by setting the relative positions of the outer circumferential wall 18*a* of the base portion 18 and the outer circumferential portion 12*a* of the impeller cup 12 in the radial and axial directions to specific predetermined positions. Also, the second labyrinth structure defined by the gap 31 can be easily formed by setting the relative positions in the radial and axial directions, respectively, of the outer circumferential wall 18*a* of the base portion 18 and the ribs 20 to the predetermined positions.

As shown in FIG. 6, the gap 31 is not provided between the outer circumferential wall 18*a* of the base portion 18 and a portion between the adjacent ribs 20. Accordingly, in order to enhance the sealing effect by the second labyrinth structure defined by the gap 31, the width of the rib 20 in a circumferential direction is preferably increased. Alternatively, the lower end portion 10*b* of the outer circumferential portion 10*a* of the rotor holder 10 may be extended axially downwards to the same level as the lower end portion 20*a* of the rib 20. With such a configuration, even in the portion between the adjacent ribs 20, a gap which is larger than the gap 31 by a thickness of the rib 20 can be arranged between the outer circumferential portion 10*a* of the rotor holder 10 and the outer circumferential wall 18*a* of the base portion 18. As a result, the sealing effect by the second labyrinth structure can be further enhanced. Note that the circumferential dimensions, radial dimensions, and/or axial dimensions of the ribs 20 may be changed to have any desirable predetermined relationship in accordance with a desired effect and desired dimensions of an end product.

Figure 7:
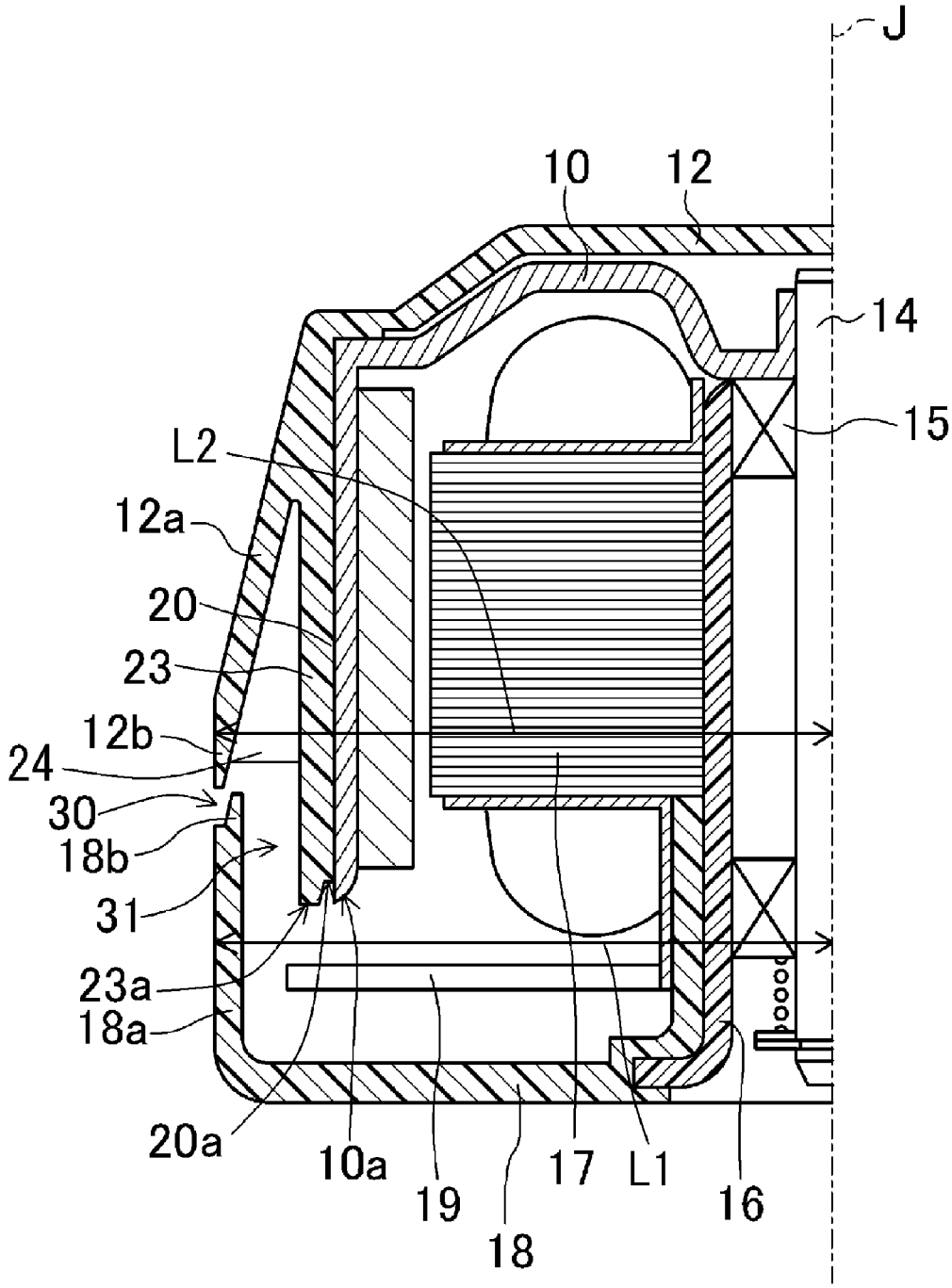
FIG. 7 is a half sectional view showing a construction of a motor portion in a ventilation fan according to a modified example of the second preferred embodiment of the present invention.

As shown in FIGS. 5 and 6, the plurality of ribs 20 are arranged inside the outer circumferential portion 12*a* of the impeller cup 12. As shown in FIG. 7, the outer circumferential portion 12*a* of the impeller cup 12 may be inclined to be separated away from the center axis toward a lower portion in the axial direction. With such a configuration, it is not necessary to decrease the thickness of a portion as the rib 20 which defines the gap 31 as shown in FIG. 5, so that the strength when the rotor holder 10 is, for example, press fitted can be increased. Note that the ribs 20 may include various radial dimensions in accordance with providing a specific predetermined inclination of the outer circumferential portion 12*a* (i.e., wider at the lower portion than the upper portion).

In the second preferred embodiment of the present invention, as shown in FIGS. 3A to 3H, in the case where the lower end portion 12*b* of the outer circumferential portion 12*a* of the impeller cup 12 is located lower in the axial direction than the upper end portion 18*b* of the outer circumferential wall 18*a* of the base portion 18, the sealing effect can be further enhanced. In addition, in the case where the lower end portion 12*b* of the outer circumferential portion 12*a* of the impeller cup 12 is located lower in the axial direction than the upper end portion 18*b* of the outer circumferential wall 18*a* of the base portion 18 all over the entire circumference, a further sealing effect can be expected.

Figure 8:
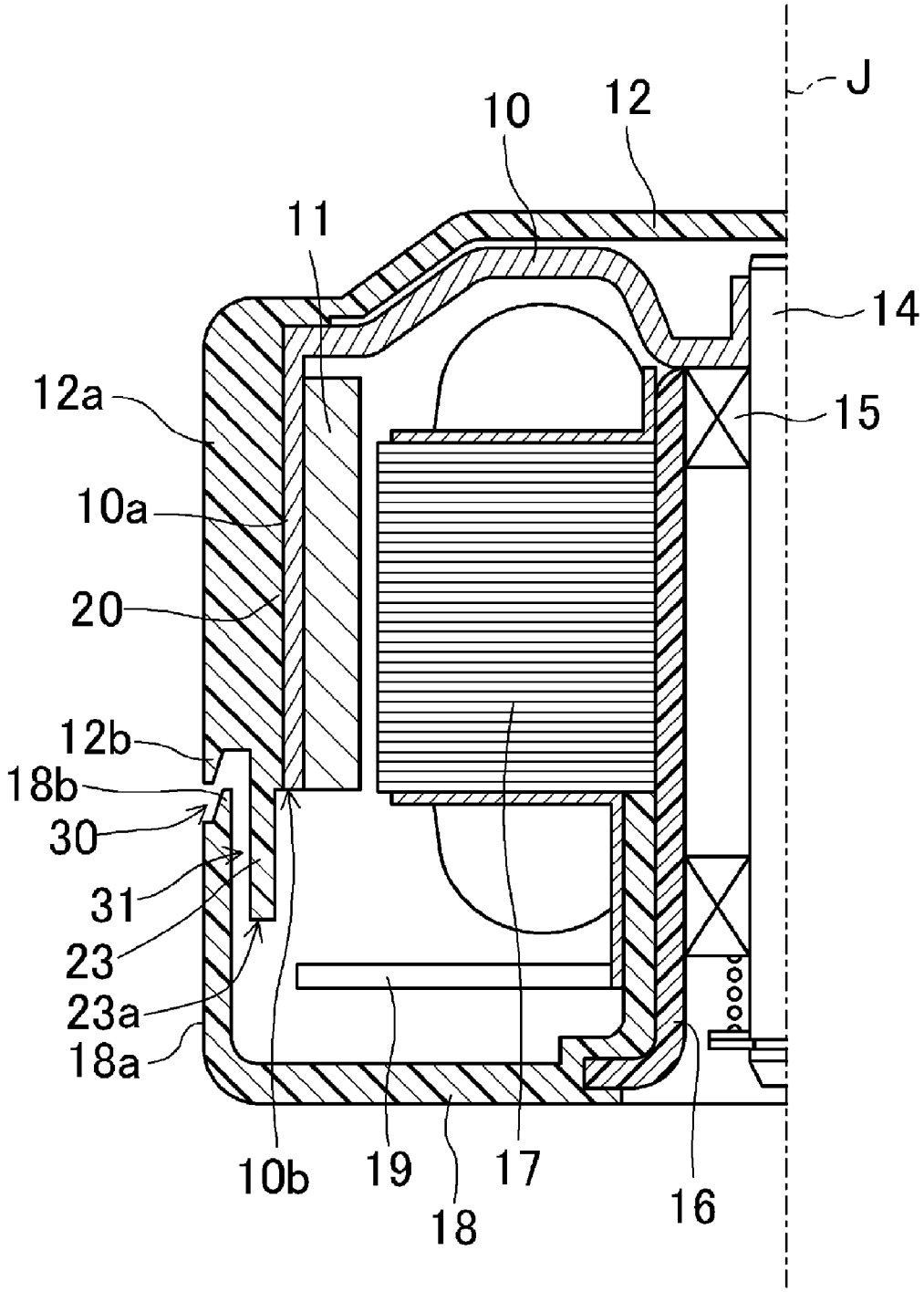
FIG. 8 is a half sectional view showing a construction of a motor portion in a ventilation fan according to another modified example of the second preferred embodiment of the present invention.
Figure 9:
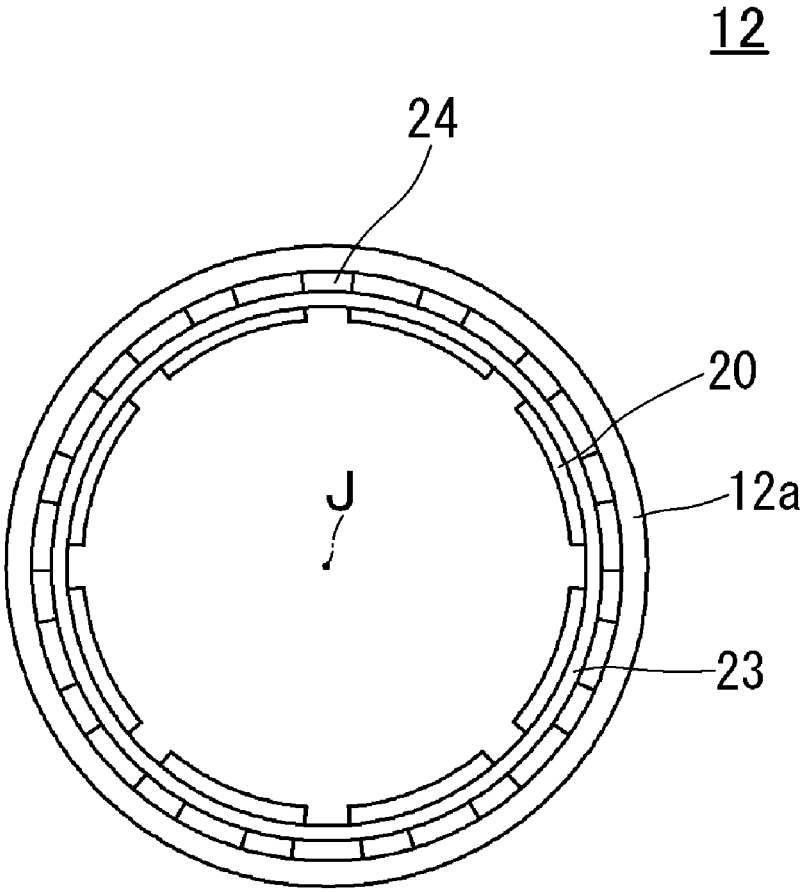
FIG. 9 is a plan view of an impeller cup in another modified example of the second preferred embodiment, when viewed from the bottom thereof.

In another modified example of the second preferred embodiment of the present invention, as shown in FIGS. 7, 8 and 9, a cylindrical portion 23 may be provided inside the outer circumferential portion 12*a* of the impeller cup 12. The cylindrical portion 23 is opposed to the inner circumferential portion of the outer circumferential wall 18*a* of the base portion 18 all over the entire circumference thereof. In more detail, a lower end portion 23*a* of the cylindrical portion 23 is located lower in the axial direction than the upper end portion 18*b* of the outer circumferential wall 18*a* of the base portion 18. With such a configuration, a gap 31 between the outer circumferential wall 18*a* of the base portion 18 and an outer circumference of the cylindrical portion 23 defines a second labyrinth structure. In this modified example, since the second labyrinth structure is formed completely over the entire circumference, so that the sealing effect can be further enhanced. At this time, a plurality of ribs 20 may be defined on an inner side in the radial direction of the cylindrical portion 23. The lower end portion 20*a* of the plurality of ribs 20 may be located axially lower than the upper end portion 18*b* of the outer circumferential wall 18*a* of the base portion 18, or may be located axially lower than the lower end portion 23*a* of the cylindrical portion 23. Note that the circumferential dimensions, radial dimensions, and/or axial dimensions of the ribs 20 may be changed to have any desirable predetermined relationship in accordance with a desired effect and desired dimensions of an end product. In this modified example, the lower end portion 10*b* of the outer circumferential portion 10*a* of the rotor holder 10 may be extended to the vicinity of the circuit board 19, or may be located axially lower than the lower end portion 23*a* of the cylindrical portion 23. In this modified preferred embodiment, a portion of the lower end portion of the blade 13 may be provided with an extending portion 13*a* which extends axially downwards as shown in FIG. 2 on an outer side in the radial direction of the outer circumferential wall 18*a* of the base portion 18. In any of the above-described cases, the sealing effect can be further enhanced. Also in this modified example, the outer circumferential portion 12*a* of the impeller cup 12 may be inclined to be separated away from the center axis toward an axially lower portion, similarly to the outer circumferential portion 12*a* of the impeller cup 12 shown in FIG. 7. At this time, the centrifugal force is applied to the air flowing from the axially upper side to the axially lower side in the outside portion of the outer circumferential portion 12*a* of the impeller cup 12, so that the velocity of the air is increased. Accordingly, the air pressure on the outside of the impeller cup 12 is lower than that on the inside thereof. Thus, the air is exhausted from the inside of the impeller cup 12 to the outside thereof through the gap 30. As a result, a further sealing effect can be provided. In addition, it is desired that a plurality of reinforcing ribs 24 may be arranged radially between the outer circumferential portion 12*a* of the impeller cup 12 and the cylindrical portion 23 at substantially regular intervals in the circumferential direction. By the provision of the reinforcing ribs 24, a molding precision of the impeller cup 12 when the impeller cup 12 is formed through injection molding can be increased, and the dimensional precision of the gap 30 between the lower end portion 12*b* of the outer circumferential portion 12*a* of the impeller cup 12 and the upper end portion 18*b* of the outer circumferential wall 18*a* of the base portion 18 can be increased. Accordingly, the dimension of the gap 30 can be made smaller such that the sealing effect can be further heightened. Furthermore, by the provision of the reinforcing ribs 24, the spread of the impeller cup 12 toward the outside in the radial direction due to the centrifugal force during the rotation can be prevented. Also in this modified preferred embodiment, as shown in FIGS. 3A to 3H, in the case where the lower end portion 12*b* of the outer circumferential portion 12*a* of the impeller cup 12 is located lower in the axial direction than the upper end portion 18*b* of the outer circumferential wall 18*a* of the base portion 18, the sealing effect can be further increased. In addition, in the case where the lower end portion 12*b* of the outer circumferential portion 12*a* of the impeller cup 12 is located lower in the axial direction than the upper end portion 18*b* of the outer circumferential wall 18*a* of the base portion 18 all over the entire circumference thereof, further sealing effect can be provided.

As shown in FIG. 7, if the base maximum radial measurement L1 is substantially equal to the impeller cup maximum radial measurement L2, or if the base maximum radial measurement L1 is smaller than the impeller cup maximum radial measurement L2, the air-flow characteristics are not deteriorated, the generation of noise can be suppressed, and the high sealing effect can be attained. The base portion 18 in this preferred embodiment has such a shape that the outside portion of the outer circumferential wall 18*a* of the base portion 18 extends in parallel or substantially in parallel to the center axis. Alternatively, the base portion 18 may have such a cup-like shape that the radial measurement of the outside portion of the outer circumferential wall 18*a* of the base portion 18 is gradually reduced from the axially upper side to the axially lower side. In such a case, if the above-mentioned relationship between L1 and L2 is established, the airflow characteristics are not deteriorated, the generation of noise can be suppressed, and the high sealing effect can be attained.

Other Preferred Embodiments

In an exemplary disclosure of the preferred embodiments of the present invention, an outer circumferential wall 18*a* which extends upwards in the axial direction is defined by an outer circumferential edge portion of a base portion 18, and a double labyrinth structure is provided in the vicinity of the upper end portion 18*b* and a side wall portion of the outer circumferential wall 18*a*, thereby attaining the waterproof and dustproof functions.

A method for attaining the waterproof and dustproof functions by covering the circuit board 19 with a resin in accordance with yet another preferred embodiment of the present invention will now be described. In this technique, the resin is injected by potting through a gap between an outer circumferential edge portion of the circuit board 19 and the outer circumferential wall 18*a* of the base portion 18. However, if the gap is narrow, the current of resin is slow, so that it requires a considerably long time to cover the circuit board 19 up to the back side thereof with the resin. In another case, the resin may not spread enough to the back side of the circuit board 19. If the gap is closed with the resin during the potting, the inside air cannot go outside, so that air bubbles may stay on the inside.

Figure 10:
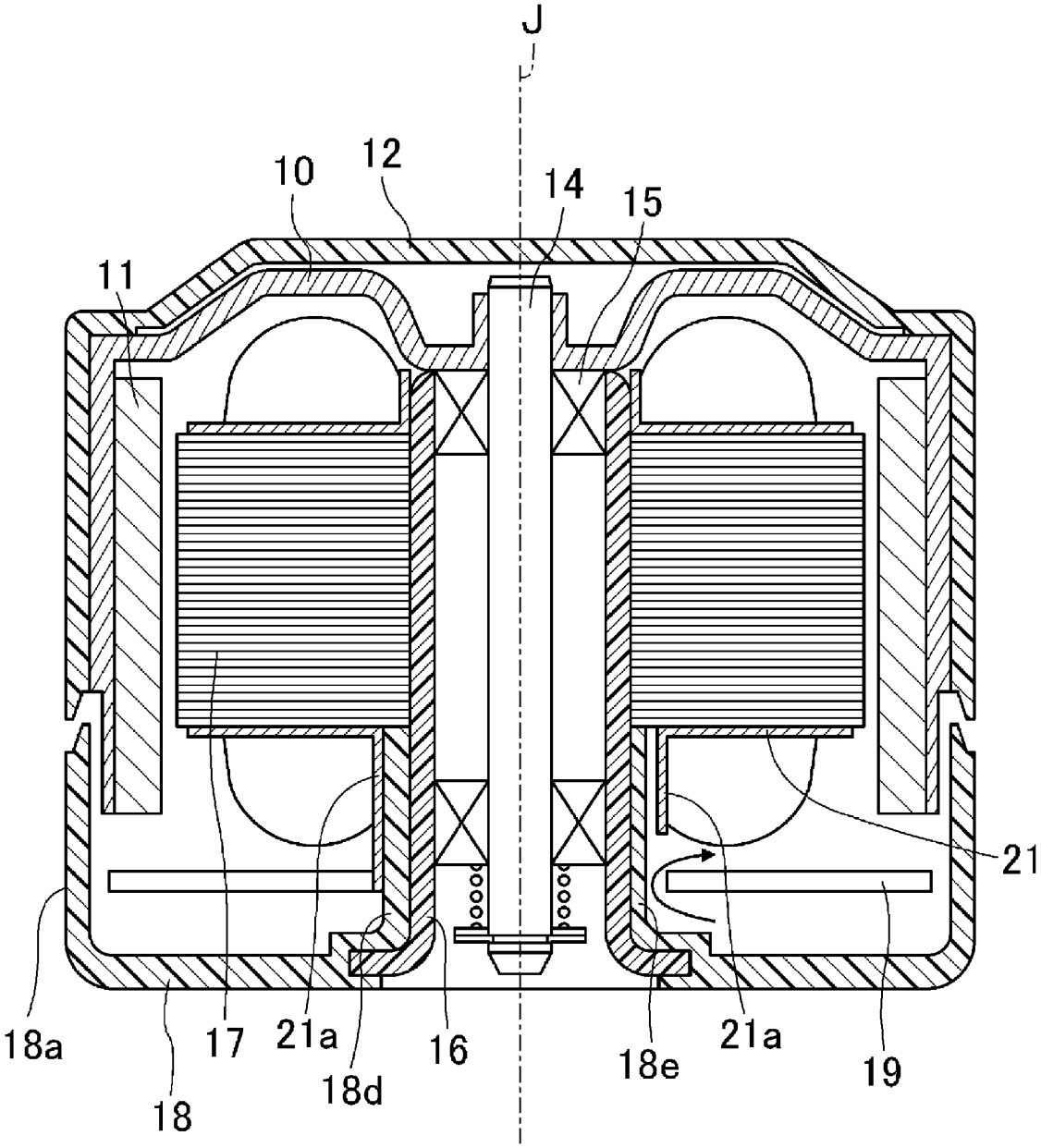
FIG. 10 is a sectional view showing a construction of a motor portion in a ventilation fan according to another preferred embodiment of the present invention.

FIG. 10 is a sectional view of the configuration of a motor portion of a ventilation fan in which the resin can be smoothly injected by potting.

Figure 11:
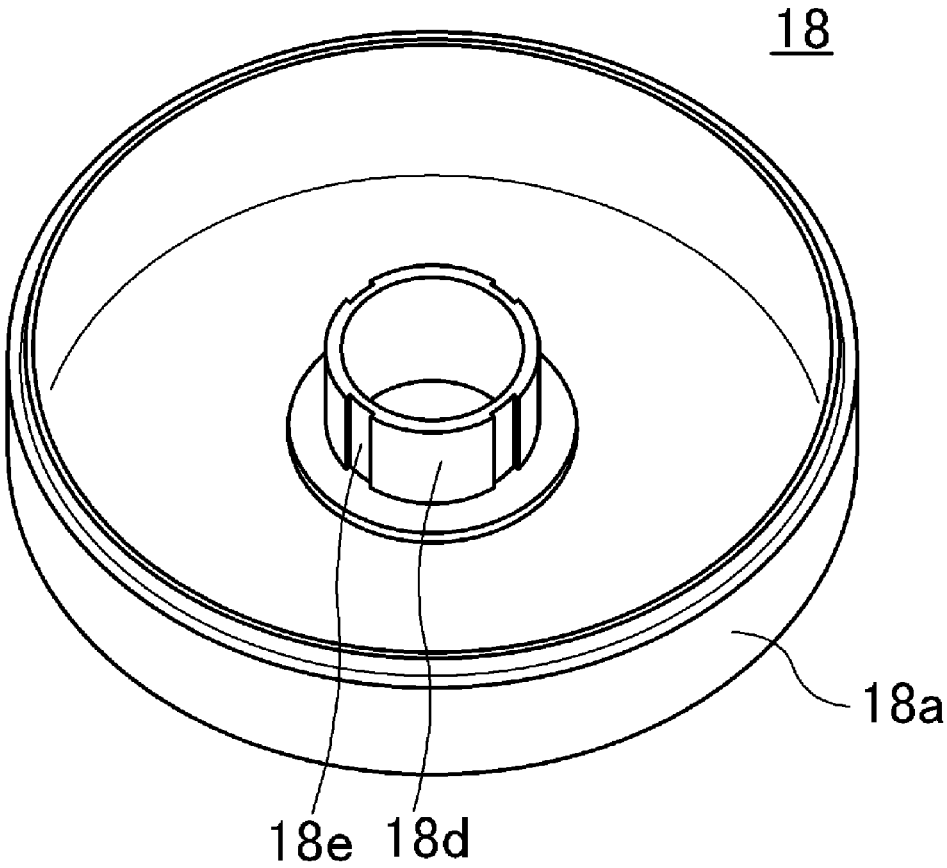
FIG. 11 is a perspective view showing a construction of a base portion in another preferred embodiment of the present invention.

As shown in FIG. 10, an inner circumferential wall 18*d* extending upwards in the axial direction is formed on an inner circumferential end of the base portion 18. A bearing holding portion 16 is fixed to an inner circumference of the inner circumferential wall 18*d*. In a portion of the inner circumferential wall 18*d*, a notch portion 18*e* having a reduced thickness is defined as shown in FIG. 11.

As shown in FIG. 10, the circuit board 19 is fixed to a side wall portion 21*a* of an insulator 21 arranged to insulate a stator core from a coil in a stator 17. In a portion of the insulator side wall portion 21*a*, a slit 21*b* having a shorter length in the axial direction is formed, as shown in FIG. 12.

As described above, by forming the notch portion 18*e* and the slit 21*b* in the vicinity of the inner circumferential end of the circuit board 19, as indicated by an arrow in FIG. 10, an air passage through which the air can flow from the back side to the top side of the circuit board 19. With such a configuration, even if the gap between the outer circumferential edge portion of the circuit board 19 and the outer circumferential wall 18*a* of the base portion 18 is closed with the resin during the injection by potting, the air passage is secured. Thus, the resin can be smoothly injected, and the occurrence of air bubbles can be prevented. As a result, the circuit board 19 can be reliably and completely covered with the resin in a short period of time.

At least one or more notch portions 18*e* may be defined on the base portion inner circumferential wall 18*d*. At least one or more slits 21*b* may be defined on the insulator side wall portion 21*a*. If the notch portion 18*e* defined on the base portion 18 and the slit 21*b* defined on the insulator 21 are located in the same position in the circumferential direction, a larger air passage can be ensured.

Figure 12:
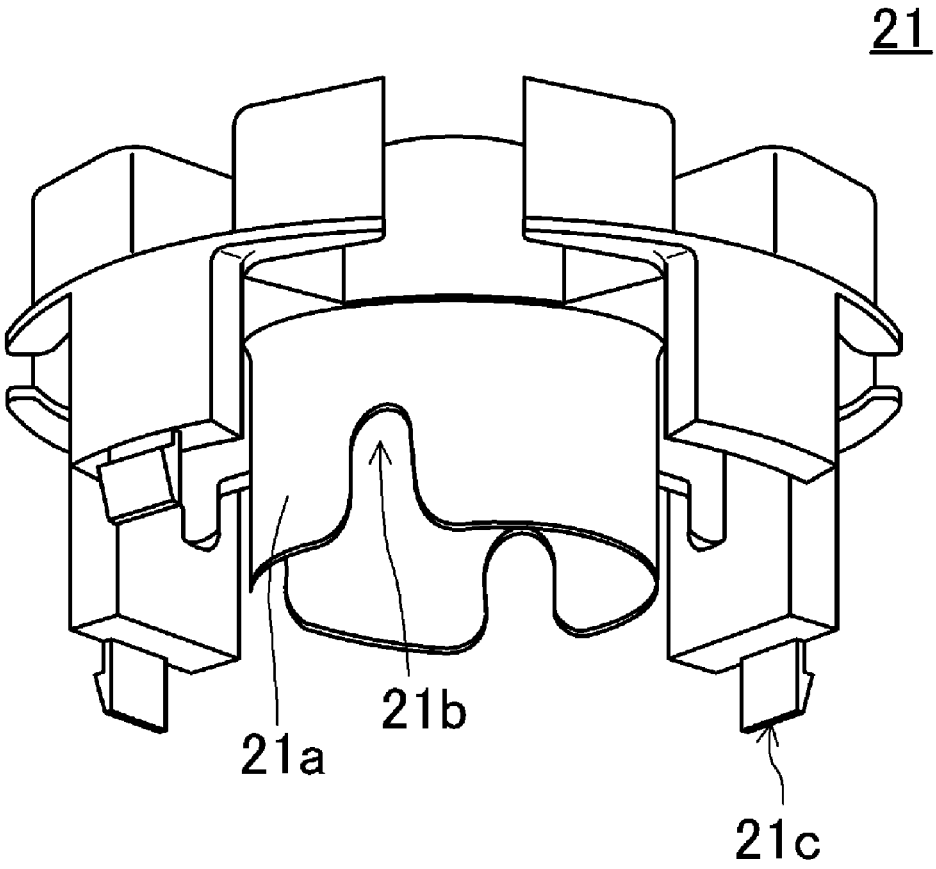
FIG. 12 is a perspective view showing a construction of an insulator in another preferred embodiment of the present invention.
Figure 13:
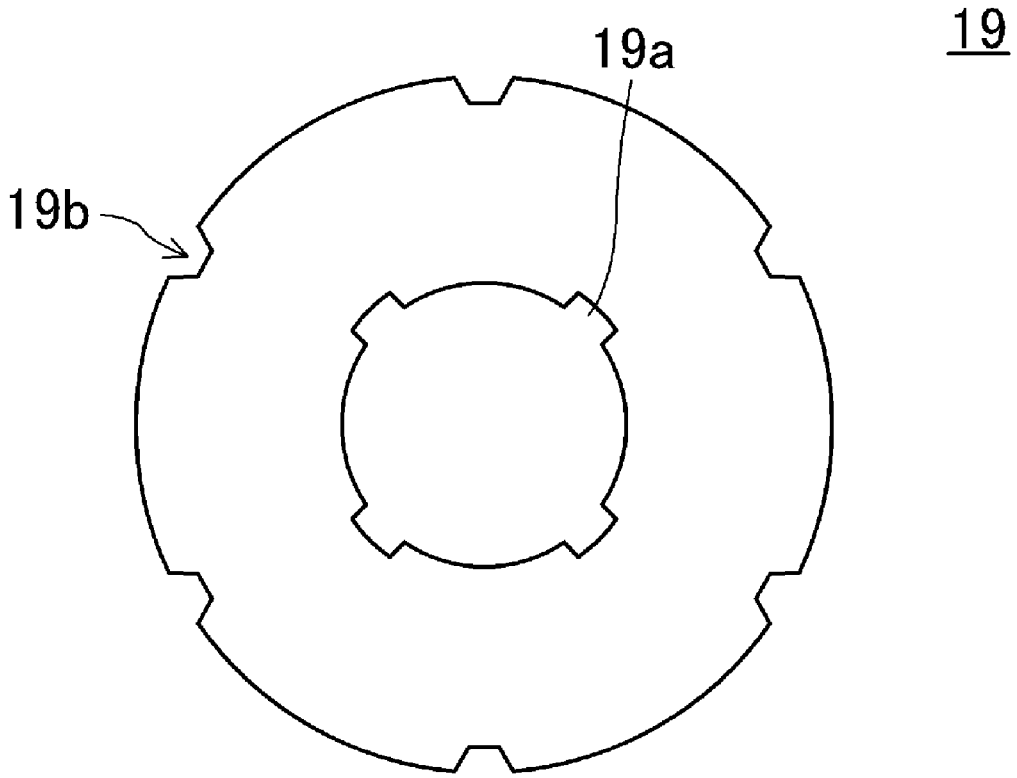
FIG. 13 is a plan view showing a construction of a circuit board in another preferred embodiment of the present invention.

An engaging claw 21*c* arranged on the insulator 21 shown in FIG. 12 is engaged with an engaging hole 19*a* defined on the inner circumferential edge portion of the circuit board 19 shown in FIG. 13, thereby fixing the circuit board 19 to the insulator 21. At this time, if the width of the engaging claw 21*c* is set to be half of that of the engaging hole 19*a*, for example, the half of the area of the engaging hole 19*a* can be used as the air passage during the injection by potting.

In addition, as shown in FIG. 13, a notch 19*b* is defined on an outer circumferential edge portion of the circuit board 19, thereby enlarging the gap for the injection by potting. Accordingly, the injection path of the resin can be ensured, so that the resin can be more smoothly injected. At least one or more notches 19*b* may be provided.

If the shape of the circuit board 19 in a plan view is non-circular, the gap between the outer circumferential edge portion of the circuit board 19 and the outer circumferential wall 18*a* of the base portion 18 can be enlarged. With such a configuration, the injection path of the resin can be ensured, so that the resin can be more smoothly injected. The shape of the circuit board 19 may be a polygonal board such as a square, a rectangular, or a diamond, for example.

Figure 14A:
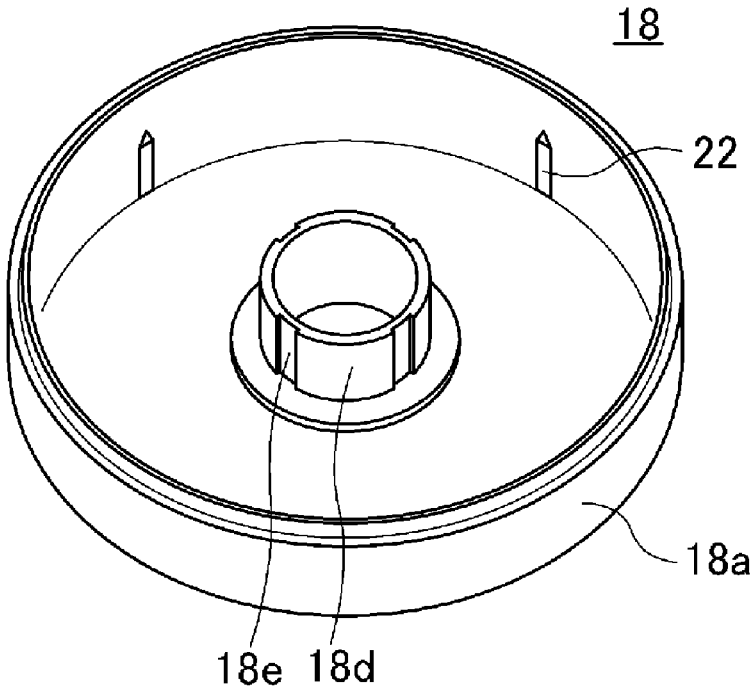
FIG. 14A is a perspective view showing a construction of the base portion in a modified example of another preferred embodiment of the present invention.
Figure 14B:
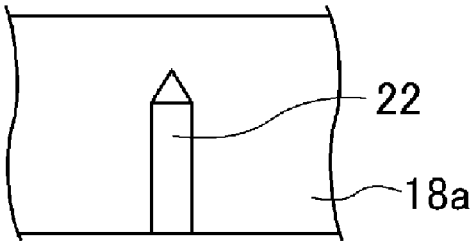
FIG. 14B is a partially enlarged view thereof.

In order to cover the circuit board 19 with the resin, it is necessary to inject a predetermined amount of resin into the cup-shaped base portion 18 having the outer circumferential wall 18*a*. Accordingly, as shown in FIG. 14A, monitoring marks 22 for use in visually monitoring the amount of injection are provided on the inner circumference of the outer circumferential wall 18*a* of the base portion 18. The top of the monitoring mark 22 may be triangular, for example, as shown in FIG. 14B. If the height of the monitoring mark 22 is previously set depending on the mounting height of the circuit board 19, the predetermined amount of resin can be exactly injected by monitoring the top level of the resin to be injected by potting to reach the triangular area. In the case where three or more monitoring marks 22 are provided, the horizontal degree of the cup-shaped base portion 18 can be visually monitored, so that the circuit board 19 can be uniformly covered with the resin.

The number of the monitoring marks 22 is not specifically limited. Preferably, three or more monitoring marks may be disposed at substantially equal intervals in the circumferential direction, so that the injection amount of the resin can be controlled more precisely. The shape of the monitoring mark 22 is not limited to be a triangle, but various shapes such as, for example, a square, a circle, or any other desirable shape can be adopted.

The present invention is described by way of the preferred embodiments, but the present invention is not limited to the above-described descriptions. It is understood that various modifications can be adopted. For example, in the above-described preferred embodiments, a ball bearing is used as the bearing portion 15 of the motor, but alternatively, an oil retaining bearing including a sleeve may be used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A ventilation fan comprising:

a rotor holder having a substantially cylindrical shape, the rotor holder being arranged to rotate around a rotation axis;

a field magnet fixed to an inner circumference of the rotor holder;

an impeller cup having a substantially cylindrical shape fixed to an outer circumference of the rotor holder, the impeller cup including a plurality of blades defined on an outer circumference thereof;

a base portion arranged to rotatably support the rotor holder through a bearing portion and a bearing holding portion;

a stator portion arranged to be supported by the bearing holding portion; and a circuit board; wherein the base portion includes an outer circumferential wall extending upwards in an axial direction from an outer circumferential edge portion thereof, an inner circumferential portion of the outer circumferential wall being directly opposed to an outer circumferential portion of the circuit board in a radial direction without any intervening elements arranged therebetween;

a gap defining a labyrinth structure is provided between an upper end portion of the outer circumferential wall of the base portion and a lower end portion of an outer circumferential portion of the impeller cup;

the impeller cup includes a cylindrical portion which is arranged to extend in the axial direction inside the outer circumferential portion thereof; and a lower end portion of the cylindrical portion is located axially lower than the upper end portion of the outer circumferential wall of the base portion and an outer circumferential portion of the cylindrical portion is directly opposed to the inner circumferential portion of the outer circumferential wall in the radial direction without any intervening elements arranged therebetween.

2. A ventilation fan according to claim 1, wherein opposed surfaces of the upper end portion of the outer circumferential wall of the base portion and the lower end portion of the outer circumferential portion of the impeller cup which are opposed through the gap are inclined upwards at substantially identical angles of inclination toward the inside in a radial direction.

3. A ventilation fan according to claim 1, wherein a section of a lower end portion of the blade includes an extending portion which is arranged to extend axially downwards on the outer side in a radial direction of the outer circumferential wall of the base portion.

4. A ventilation fan according to claim 1, wherein the ventilation fan is an axial fan which intakes the air from one end in an axial direction and exhausts the air from the other end in the axial direction.

5. A ventilation fan according to claim 1, wherein the outer circumferential portion of the impeller cup is inclined away from the center axis toward a lower portion of the impeller cup in the axial direction.

6. A ventilation fan according to claim 1, wherein the lower end portion of the outer circumferential portion of the impeller cup is located lower in the axial direction than the upper end portion of the outer circumferential wall of the base portion.

7. A ventilation fan according to claim 1, wherein the lower end portion of the outer circumferential portion of the impeller cup is located lower in the axial direction than the upper end portion of the outer circumferential wall of the base portion along the entirety of the circumference of the outer circumferential wall.

8. A ventilation fan according to claim 1, wherein the lower end portion of the outer circumferential portion of the rotor holder is located axially lower than the upper end portion of the outer circumferential wall of the base portion.

9. A ventilation fan according to claim 1, wherein a maximum radial measurement in an outside portion of the outer circumferential wall of the base portion is substantially equal to a maximum radial measurement in an outside portion of the outer circumferential portion of the impeller cup.

10. A ventilation fan according to claim 1, wherein a maximum radial measurement in an outside portion of the outer circumferential wall of the base portion is smaller than a maximum radial measurement in an outside portion of the outer circumferential portion of the impeller cup.

11. A ventilation fan according to claim 1, wherein the impeller cup includes a plurality of ribs which are arranged to extend in the axial direction inside the cylindrical portion of the impeller cup.

12. A ventilation fan according to claim 5, wherein the plurality of reinforcing ribs arranged to connect the outer circumferential portion of the impeller cup with the cylindrical portion are arranged in the circumferential direction.

13. A ventilation fan according to claim 12, wherein the reinforcing ribs are arranged at substantially regular intervals in the circumferential direction.

* * * * *